United States Patent [19]

Rahaim et al.

[11] Patent Number: 4,693,045

[45] Date of Patent: Sep. 15, 1987

[54] EXHAUST STACK SUPPORT ARRANGEMENT

[75] Inventors: Thomas J. Rahaim, Claymont, Del.; Nicholas D. Xanthopoulos, Havertown, Pa.

[73] Assignee: Westinghouse Electric Corp., Pittsburgh, Pa.

[21] Appl. No.: 760,380

[22] Filed: Jul. 30, 1985

[51] Int. Cl.[4] ..... E02D 27/42

[52] U.S. Cl. ..... 52/292; 52/573; 52/167

[58] Field of Search ..... 52/292, 167, 573, 245, 52/295, 299, 573; 165/47, 48.1; 202/222, 270; 261/DIG. 11

[56] References Cited

U.S. PATENT DOCUMENTS

| | | | |
|---|---|---|---|
| 981,884 | 1/1911 | Ruhl | 52/167 |
| 2,014,643 | 9/1935 | Bakker | 52/167 |
| 2,968,458 | 1/1961 | Moeller | 52/167 |
| 4,574,540 | 3/1986 | Shiau | 52/167 |

*Primary Examiner*—John E. Murtagh

[57] ABSTRACT

A support arrangement for an exhaust stack includes an array of beam segments 31 which have their lower flanges 34 rigidly attached to a concrete foundation pad 32, their upper flanges 40 rigidly attached to the base plate 12 of the exhaust stack, with the beam segments being oriented as shown in FIG. 5 so that the web 44 is at a right angle to a line 48 passing through the base anchor support location 46 and through the web 44 so that with thermal expansion and contraction each web 44 is disposed to permit bending or flexure in accordance with the longitudinal and lateral distance between the web and the anchor location.

2 Claims, 6 Drawing Figures

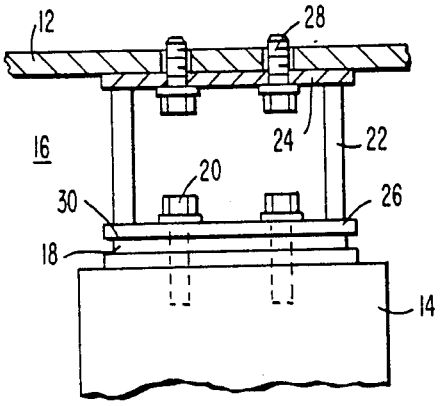
FIG.3
PRIOR ART
FIG.4
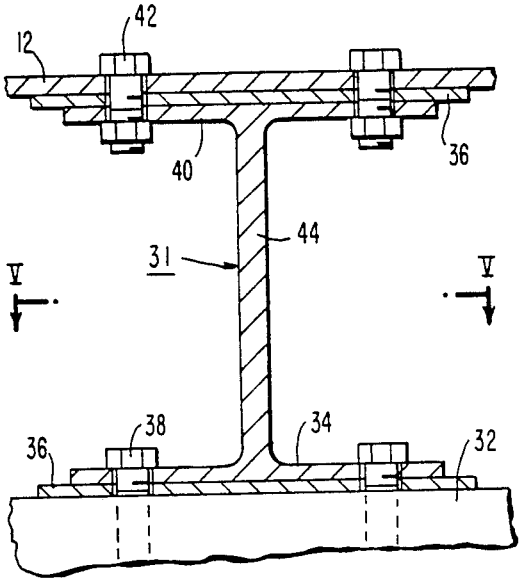
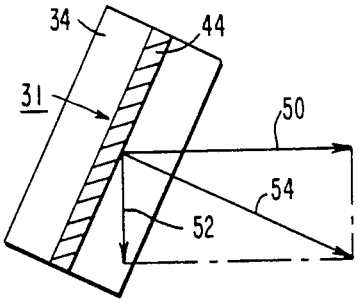
FIG.6

EXHAUST STACK SUPPORT ARRANGEMENT

BACKGROUND OF THE INVENTION

This invention pertains to a mounting arrangement for a large exhaust stack which receives high temperature combustion gases from a device such as a large gas turbine.

One prior art mounting arrangement for exhaust stacks is illustrated in FIGS. 1–3. While the prior art arrangement will be described in some detail later, that arrangement uses a series of separate concrete pier supports which carry a steel structural support arrangement at its top and underlying the base of the exhaust stack, with the steel support including several horizontal plates which are intended to slide relative to each other at a greased interface to take up the thermal expansion and contraction of the base of the exhaust stack. If the installation of such a system is done correctly, and if the grease is applied correctly, the system performs satisfactorily. However, due to installation difficulties at times, especially if the stack is supported at a large number of points, or if the relative motion at the interface takes place in the absence of proper greasing, or if there is contact between moving parts and the anchor bolts which extend down into the concrete piers, tensile and shear forces can induce cracking and final failure of the concrete pier.

The aim of this invention is to provide a new mounting arrangement which has the advantages of eliminating the need for concrete piers which are subject to cracking, which is relatively easily installed, and which eliminates the need for greasing of an interface.

SUMMARY OF THE INVENTION

In accordance with the invention, the exhaust stack is provided with a support arrangement including means anchoring one relatively small, discrete area of the stack base from a concrete pad in substantially fixed position so there is substantially no movement of this discrete area relative to the pad, a series of separate support columns between the pad and the underside of the base in an array to adequately support the entire area of the base from the pad, each support column including a structural beam section including top and bottom flange means and an intermediate web, the top and bottom flange means being fixed against movement relative to said base and said pad, respectively, each support column being oriented with the web thereof substantially transverse to a line passing through the anchor location and the web so that each web is disposed to permit bending to the required extent in accordance with the lateral and longitudinal displacement of the base at the particular column location relative to the anchor location.

BRIEF DESCRIPTION OF THE DRAWINGS

FIG. 3 is a partly sectional view of a single concrete pier support with the prior art support arrangement;

FIG. 4 is a partly sectioned view of a single column support according to the arrangement of the invention;

FIG. 6 is a vector diagram illustrating the longitudinal and lateral thermal expansion forces exerted upon a given support column at a particular location.

DESCRIPTION OF THE PRIOR ART AND PREFERRED EMBODIMENT

Figure 1:
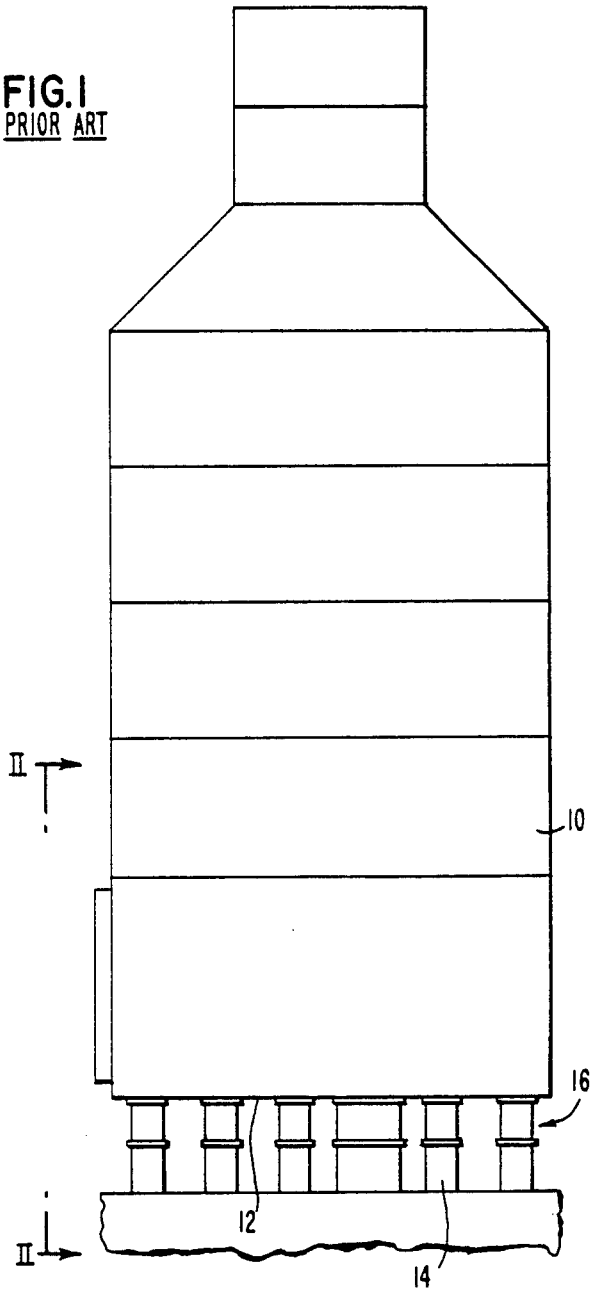
FIG.1 PRIOR ART
FIG. 1 is a partly schematic illustration of an exhaust stack having a mounting arrangement according to the prior art.
Figure 2:
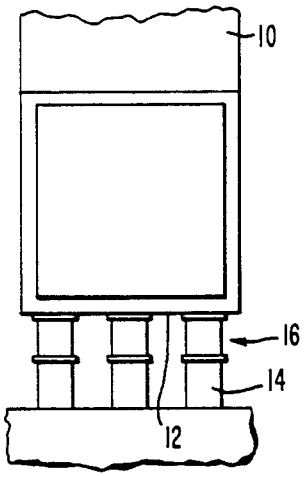
FIG.2 PRIOR ART
FIG. 2 is a fragmentary end view of the lower part of the stack.

Referring to FIGS. 1 and 2, the exhaust stack 10 is adapted to receive high temperature exhaust gas from a device such as a gas turbine, as indicated by the arrow to the left of FIG. 1. While stack sizes will obviously vary, one stack to which the invention has been applied has a base of about 13 feet (4 m) by 35 feet (10.5 m) by 70 feet high. The base 12 of the stack is supported by an array of individual concrete piers 14 which carry the plate and column arrangement generally designated 16 upon their upper surfaces.

Referring now to FIG. 3 for details of the prior art support arrangement, plate means 18, which has a smooth upper surface is mounted on top of the pier 14 and is held in place loosely by the studs 20 which are sunk into the concrete pier. The legs 22 of the support column are welded at top and bottom to the plates 24 and 26, respectively, the upper plate 24 being secured to the stack base 12 by the bolts 28 and the lower plate 26, which has a smooth flat lower face, rests upon the plate means 18. The interface between 18 and 26 is called a grease face since provision is made through means not shown to pump grease into the interface 30.

When the base 12 moves because of thermal expansion or contraction in accordance with the operational mode of the turbine, the prior art column 16 is intended to move with the base, with relative motion occurring at the grease interface 30. As noted before, if the system is installed correctly, and if grease is applied correctly, and adequately frequently, this system satisfactorily takes up the thermal expansion and contraction of the base. However if there are installation difficulties with the base being supported at many points, or if the relative motion at the interface takes place with dry plates, or if there is a contact between any of the moving parts and the anchor studs in the pier, high horizontal loads are transmitted to the piers which can induce cracking and ultimate failure of the pier.

In accordance with the invention, the concrete piers 14 are totally eliminated, as well as the sliding mechanism and, instead the thermal expansion and contraction is accommodated through the deflection or bending of the web of a structural beam segment generally designated 31 in FIG. 4. A concrete pad 32, basically coextensive with the area of the stack 12 base is provided. The lower flange 34 of the bea segment 31 rests upon an adapter plate 36, with the flange and plate rigidly attached to the concrete pad through fasteners 38. The upper flange 40 is likewise rigidly attached to the base 12 by fasteners 42 with an intermediate adapter plate 36 between the flange and base. The adapter plates are a convenience for some installations and are not a necessary part of the invention.

Figure 5:
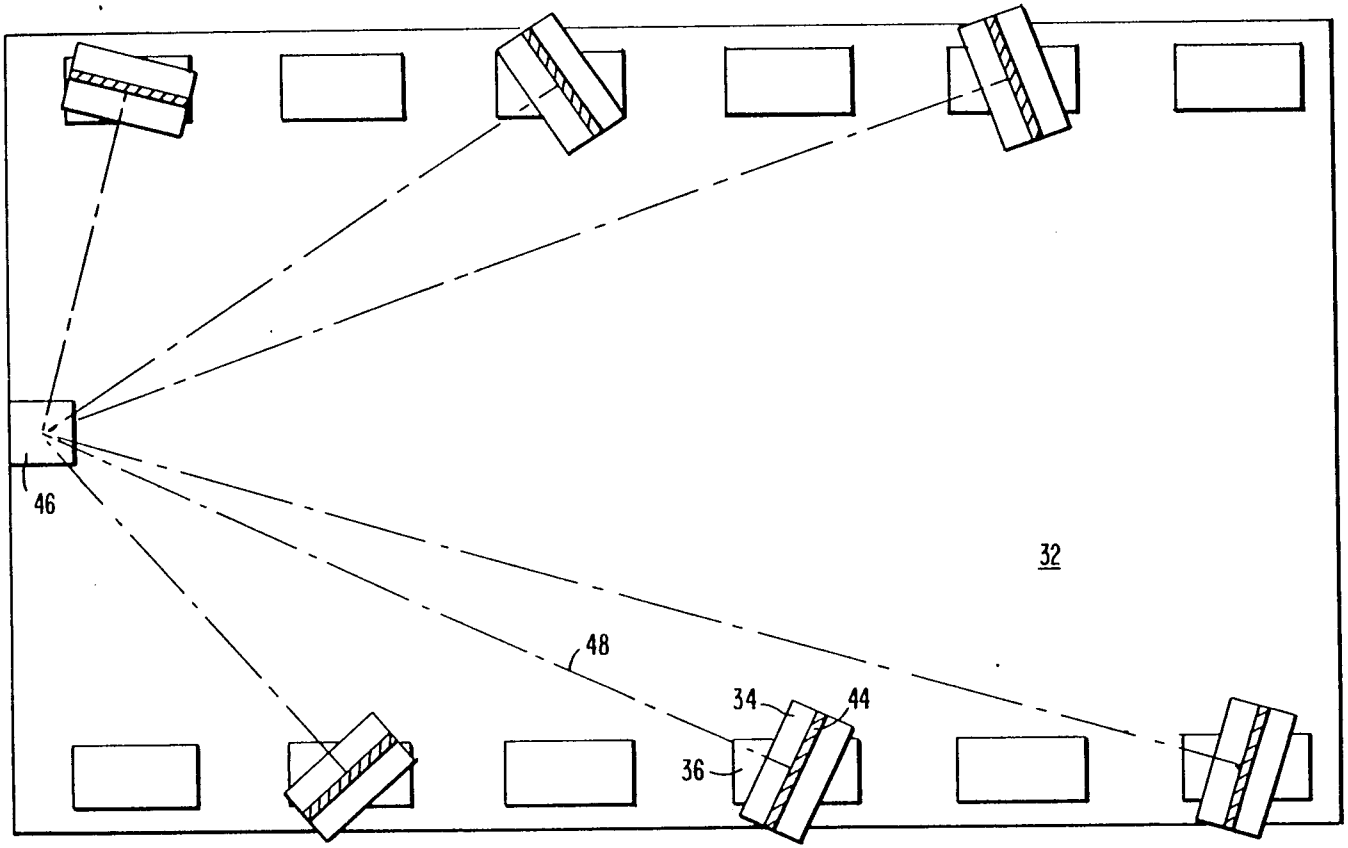
FIG. 5 is a plan view of the concrete pad foundation with several examples of the orientation of the structural column supports, this view corresponding to the view taken along the line V—V of FIG. 4 but encompassing the entire area of the concrete pad.

For the arrangement according to the invention to properly function, it requires that the beam segment 31 be properly oriented so that the web 44 of the beam segment is correspondingly properly oriented. Turning now to FIG. 5, the scheme of the invention will be readily appreciated. The adapter plates 36 are laid out in an array along the longitudinal sides of the concrete pad 32 in a number sufficient to provide adequate support to the exhaust stack. At one location underlying the base area, as at the center of the end into which exhaust gas is received for example, a concrete anchor pier 46 is provided and it is to this that the corresponding area of the base plate 12 is rigidly attached so that there is substantially no relative movement between the base plate and pier 46. A structural beam segment 31 is supported on each of the adapter plates 36. Each beam segment is oriented with the web thereof substantially transverse to a line as indicated at 48 passing through the anchor location 46 and the web 44 so that each web is disposed to permit bending or deflection to the required extent in accordance with the lateral and longitudinal displacement of the base at the particular support column location, relative to the anchor location.

In FIG. 6, the vector diagram shows the resultant direction of motion or force due to both the longitudinal expansion and the lateral expansion at a given support column location. The arrow 50 represents the longitudinal expansion while the arrow 52 represents the lateral expansion with the arror 54 representing the resultant direction of motion of that area of the base relative to the underlying concrete pad. The line 50 is of course proportional to the longitudinal distance from the given support column to the anchor pier while the line 52 is proportional to the lateral distance between the column and the anchor pier. The motion of the base where the top flange of the beam is rigidly attached, causes the web to bend as a guided cantilever beam since the beam is rigidly attached to the foundation along its bottom flange. The beam section for a particular exhaust stack is selected to keep the combined bending, buckling and shear stresses imposed upon the beam under the most critical loading conditions within allowable limits. As a typical example, the beams for the noted exhaust stack serving a 60 megawatt turbine were about two and a half to three feet (0.76 to 0.9 m) long and had webs about two and a half feet (0.76 m) high. While the web deflection is not readily apparent visually without measurement, in one operating installation in which the turbine was operating at around 65 megawatts in a stabilized condition, deflection of the web was measured at about one half inch (0.0125 m) at the locations farthest from the anchor point, with correspondingly lesser deflections at points correspondingly closer to the anchor point.

We claim:

1. A support arrangement for mounting, on a concrete or similar material foundation pad, a large exhaust stack for a gas turbine or the like in which the base of the stack is subject to significant thermal expansion and contraction due to changes in base temperature in accordance with the operating condition of the turbine, comprising:

means anchoring and supporting one relatively small, discrete area of said base from said pad in substantially fixed position relative to said base area;

a series of separate support columns between said pad and the underside of said base in an array to adequately support the entire area of said base;

each support column including a structural beam segment including top and bottom flange means and an intermediate web, said top and bottom flange means being fixed against movement to said base and said pad, respectively;

each support column being oriented with the web thereof substantially transverse to a line passing through said anchor location and said web so that each web is disposed to permit bending to the required extent in accordance with the lateral and longitudinal displacement of the base at the particular column location, relative to said anchor location.

2. Support arrangement according to claim 1 wherein:

said structural beam segments have the shape of an I-beam.

* * * * *